US005181638A

United States Patent [19]

McHale

[11] Patent Number: 5,181,638

[45] Date of Patent: Jan. 26, 1993

[54] BACKPACK WITH INDEPENDENTLY ADJUSTABLE STABILIZING STRAPS AND SHOULDER PADS

[76] Inventor: Daniel M. McHale, 3431 12th Ave. W., Seattle, Wash. 98119

[21] Appl. No.: 806,101

[22] Filed: Dec. 9, 1991

[51] Int. Cl.[5] ..... A45F 3/04

[52] U.S. Cl. ..... 224/215; 224/209; 224/211; 224/259; 224/262; 224/264

[58] Field of Search ..... 224/150, 153, 202, 209, 224/210, 211, 212, 215, 216, 257, 258, 259, 260, 261, 262, 263, 264; 206/315.3, 315.11

[56] References Cited

U.S. PATENT DOCUMENTS

| | | | |
|---|---|---|---|
| 2,461,526 | 2/1949 | Cull et al. | 224/209 |
| 3,282,483 | 11/1966 | Babcock | 224/264 X |
| 3,885,722 | 5/1975 | Robertson | 224/264 X |
| 3,921,867 | 11/1975 | Farnbach | 224/262 |
| 4,420,103 | 12/1983 | Douglass | 224/210 |
| 4,676,418 | 6/1987 | Lowe | 224/215 |
| 4,883,207 | 11/1989 | McArthur | 224/153 |
| 5,012,964 | 5/1991 | Falletta et al. | 224/209 X |
| 5,114,059 | 5/1992 | Thatcher | 224/209 |

FOREIGN PATENT DOCUMENTS

| | | | |
|---|---|---|---|
| 166788 | 7/1954 | Australia | 224/259 |
| 9105493 | 5/1991 | World Int. Prop. O. | 224/215 |

*Primary Examiner*—Allan N. Shoap
*Assistant Examiner*—Stephen Cronin
*Attorney, Agent, or Firm*—Russell W. Illich

[57] ABSTRACT

An improved strap assembly is provided for use with a backpack for allowing the independent adjustment of the stabilizing straps and shoulder pads of a backpack. The strap assembly includes a pair of shoulder pads anchored at one end to the backpack and at the opposite end to a pair of first adjustment buckles. A shoulder pad adjustment strap is also threaded through the first buckle and is anchored at the lower end of the backpack. A second pair of adjustment buckles are attached at the upper end of the backpack and have a pair of stabilizing straps threaded therethrough. The stabilizing straps slide freely through cross straps upon the shoulder pads and also slide freely through a widened opening within the first adjustment buckles. Each stabilizing strap is anchored at the lower end of the backpack adjacent the anchorage of the shoulder pad adjustment strap to the backpack. The ability of the stabilizing strap to slide freely relative to the shoulder pad allows for independent adjustment of either the shoulder pad adjustment strap or the stabilizing strap without adverse affect upon the adjustment of the other strap.

8 Claims, 2 Drawing Sheets

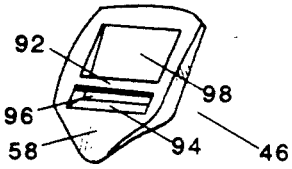
Figure 4
Figure 3
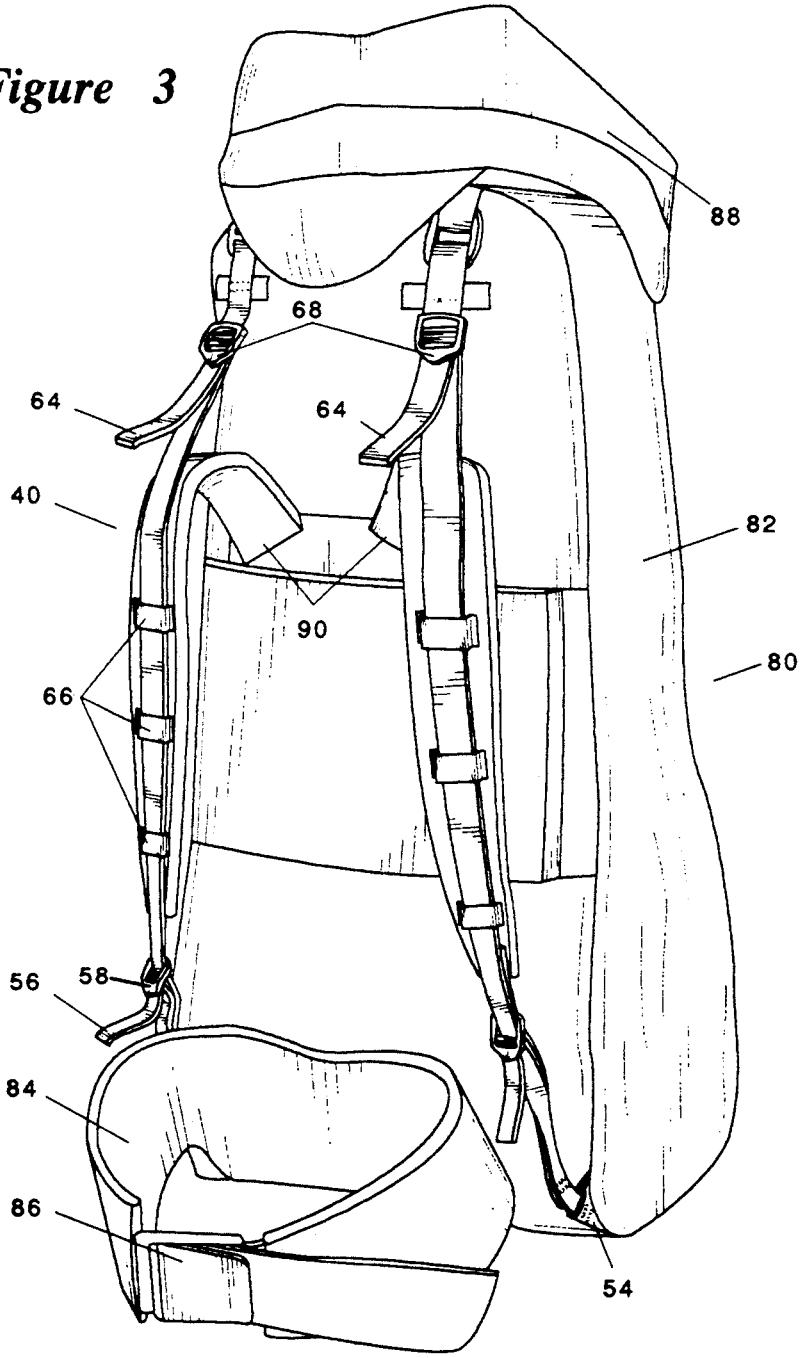

BACKPACK WITH INDEPENDENTLY ADJUSTABLE STABILIZING STRAPS AND SHOULDER PADS

BACKGROUND OF THE INVENTION

The present invention relates to an improvement in the adjustment of the straps of a backpack. Specifically, most conventional backpacks have a pair of shoulder pads which bear the weight of the backpack and a pair of stabilizing straps interlinked with the shoulder pads that allows a user to adjust the load closer to or further away from the backpacker's body.

In the past, innovations within the adjustable straps of backpacks have largely been confined to aesthetic design changes. For example, currently, a popular change in the form of the shoulder pads is a change in the shape of the pad which is curved to an S-shape. Such a modification does little or nothing to improve the operating characteristics of the backpack to make it more comfortable or easier-to-use for the backpacker.

One problem with backpacks currently on the market is that they all have interlinked shoulder pad straps and stabilizing straps. This causes the adjustment of one of the pairs of straps to affect the adjustment of the other pair of straps. Often, when hiking over a long distance, the hiker will want to adjust the load by adjusting one or the other set of straps. Unfortunately when he/she attempts to adjust one of the sets of straps, the other set of straps goes out of adjustment. This problem is even more compounded when the second set of straps is counter-adjusted back to their original position, because the counter-adjustment will subsequently move the originally adjusted straps out of position. Hence, a backpacker that wishes to simply make one adjustment to his/her backpack will have to make several adjustments of the shoulder and stabilizing straps. Ultimately, a backpacker must learn to overcompensate on the adjustment of the first pair of straps, so that only one adjustment of the second pair of straps is needed.

The present invention resolves this multiple adjustment problem by making the shoulder and stabilizing straps independently adjustable.

SUMMARY OF THE INVENTION

It is an object of this invention to provide an improved strap system for a backpack that allows for independent adjustment of the shoulder pads and stabilizing straps.

Another object of the invention is to provide an improved strap system that is similar to conventional strap systems in the general position of the shoulder pads and stabilizing straps upon the backpack.

It is a further object of the invention to provide an improved strap system that is economical and easy to manufacture and assemble.

Other objects of the invention will be apparent hereinafter from the specification and from the recital of the appended claims, particularly when read in conjunction with the accompanying drawings.

The present invention comprises an improved strap system for a backpack. The strap system includes a conventional shoulder pad anchored at one end to an intermediate point on the backpack. The other end of the top shoulder pad is attached to a shoulder pad adjustment buckle. The shoulder pad further includes an adjustment strap that is threaded through a portion of the buckle and anchored at the bottom of the backpack.

The shoulder pad is adjusted by pulling on the free end of the adjustment strap. The strap system further includes a stabilizing strap that includes an anchor strap for anchoring the stabilizing strap to the top of the backpack through a second buckle. The stabilizing strap is threaded through a slot within the second buckle and is loosely threaded through cross-straps on the shoulder pad and an opening in the first buckle. The stabilizing strap is anchored to the bottom of the backpack in a fashion similar to the shoulder pad adjustment strap. The stabilizing strap is adjusted by pulling on the free end of the strap toward the top of the backpack. The adjustment of the stabilizing strap is independent of the shoulder pad because it slides loosely within the cross-straps and the lower buckle. It does not affect any of the portions of the shoulder pad assembly. Likewise, the adjustment of the shoulder pads does not affect the adjustment of the stabilizing straps in any manner because of the loose connection of the stabilizing straps through the cross-straps and lower buckle.

BRIEF DESCRIPTION OF THE DRAWINGS

FIG. 3 shows an overall perspective view of the strap system of FIG. 2 mounted upon a backpack.

FIG. 4 shows a perspective view of the shoulder pad adjustment buckle of FIG. 2.

DETAILED DESCRIPTION OF THE INVENTION

Figure 1:
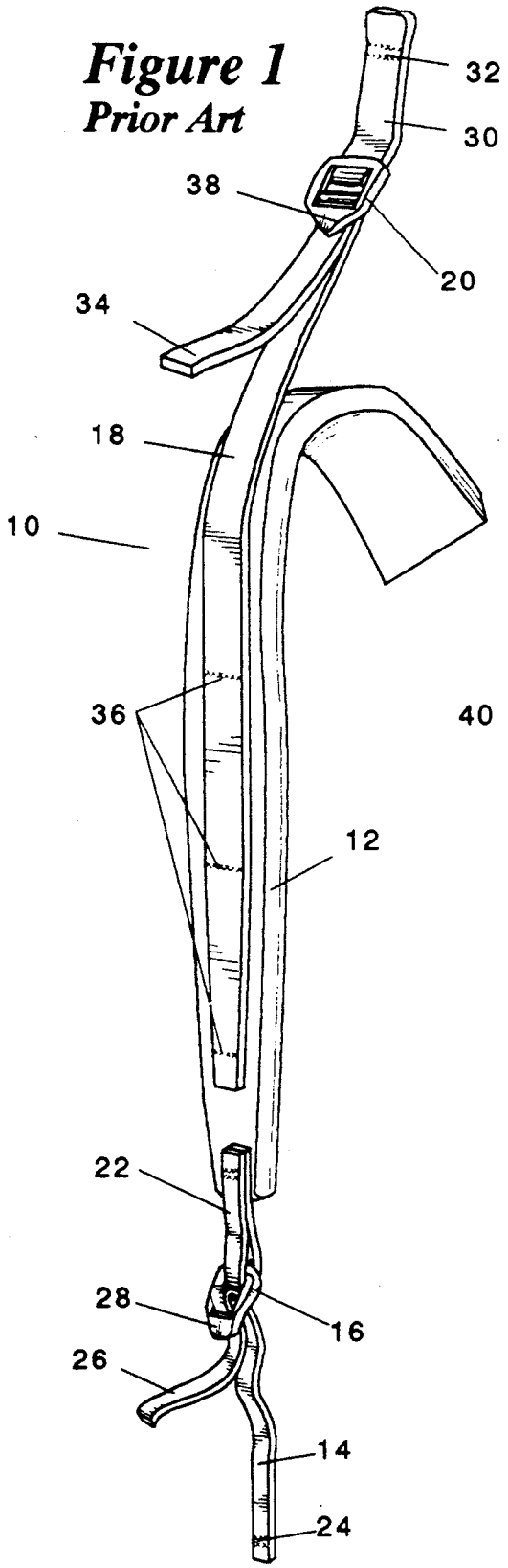
Figure 1 Prior Art
FIG. 1 shows a perspective view of a prior art version of a shoulder strap interlinked to a stabilizing strap.

FIG. 1 shows a prior art view of the conventional strap system of most backpacks currently on the market. The strap system 10 includes a shoulder pad 12 and a shoulder pad adjustment strap 14 connected to a lower buckle 16. The stabilizing strap 18 is threaded through an upper buckle 20 to allow for adjustment of the angle of the backpack with the user's back. The shoulder pad adjustment strap 14 adjusts the weight of the load upon a user's shoulders.

The shoulder pad assembly further includes a buckle attachment loop 22 which fastens the shoulder pad 12 to the lower buckle 16. The shoulder pad adjustment strap 24 is anchored to the bottom of the backpack by stitching 24. The shoulder pads are tightened or cinched upon the shoulders by pulling on the free end 26 of the shoulder pad adjustment strap 24. Conversely, the shoulder pads are loosened by pulling upwardly on a lift tab 28 of the lower buckle 16. This action allows slack to occur within the shoulder pad adjustment strap 14.

The stabilizing strap assembly further includes an upper buckle anchor strap 30 for anchoring the buckle 20 to the top of the backpack by stitching 32. To adjust the angle of the backpack inwardly against the user's back, the free end 34 of the stabilizing strap 18 is pulled. To adjust the backpack outwardly away from a user's back, the lift tab 38 of buckle 20 is pulled upwardly to cause slack to build within the stabilizing strap 18.

The main problem with this prior art strap assembly is that the adjustment of either the shoulder pad strap or the stabilizing strap will adversely affect the adjustment of the other strap because the stabilizing strap 18 is directly anchored upon the shoulder pad 12 by stitching 36. Hence, if a backpacker wishes to loosen only the shoulder pad 12 by pulling upwardly upon the lift tab 28, the slack that occurs within shoulder pad adjustment strap 14 also causes slack within the stabilizing strap 18. The stabilizing strap 18 must then be pulled upon to re-tighten it to its original position which subsequently re-tightens the shoulder pad 12 to some degree. Therefore, to achieve a desired adjustment of a single strap, the stabilizing strap and shoulder pads must be adjusted back and forth in a tug-of-war manner until the desired adjustment is achieved. A backpacker that frequently uses his/her backpack eventually learns that the adjustment process can be shortened by overcompensating the first adjustment (building more than enough slack in the shoulder pad) and subsequently arriving at the desired position of the backpack upon the second adjustment (re-tightening of the stabilizing strap). However, this learning process takes awhile to learn, and is not an intuitive process. Furthermore, most users of backpacks are relatively infrequent backpackers and often never learn the subtleties of this adjustment process. It should be appreciated that this tug-of-war adjustment process applies not only to the loosening of the shoulder pad, as explained above, but also to the tightening of the shoulder pad, the loosening of the stabilizing strap, and the tightening of the stabilizing strap, as well. Any one of these four adjustments will require additional adjustments due to the interconnection of the stabilizing strap with the shoulder pad.

Figure 2:
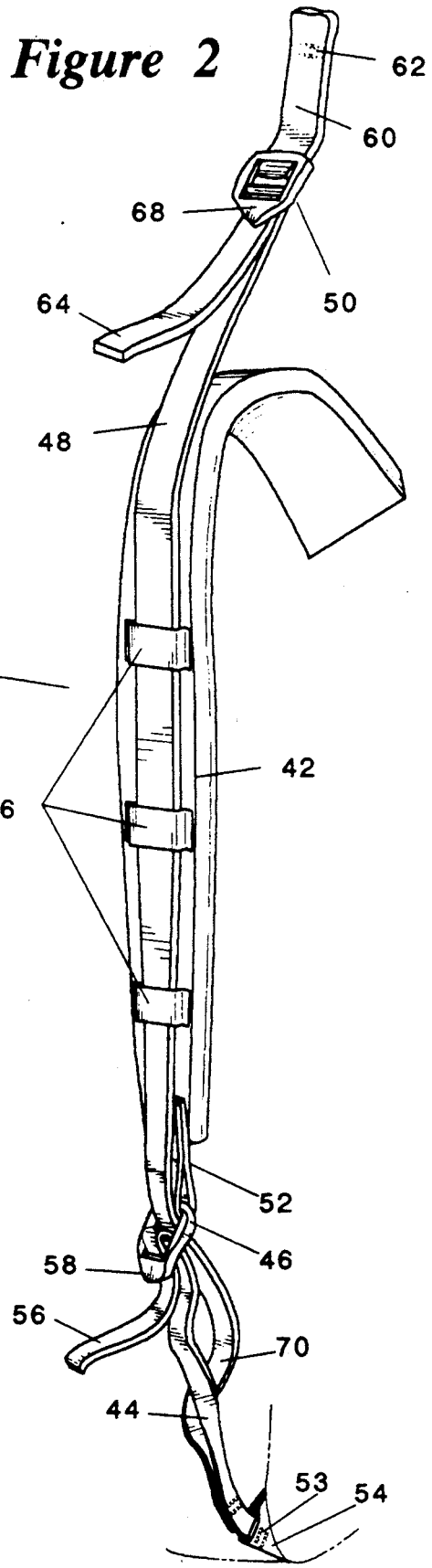
FIG. 2 shows a perspective view of the shoulder and stabilizing strap system of the present invention.

FIG. 2 shows a perspective view of the improved strap system of the present invention. The strap system 40 includes a shoulder pad 42 and a shoulder pad adjustment strap 44 connected to a lower buckle 46. The stabilizing strap 48 is threaded through an upper buckle 50 to allow for adjustment of the angle of the backpack with the user's back. The shoulder pad adjustment strap 44 adjusts the weight of the load upon a user's shoulders.

The shoulder pad assembly further includes a buckle attachment loop 52 which fastens the shoulder pad 42 to the lower buckle 46. The shoulder pad adjustment strap 44 is anchored to the bottom of the backpack by a triangular attachment portion 54 through stitching 53. The shoulder pads are tightened or cinched upon the shoulders by pulling on the free end 56 of the shoulder pad adjustment strap 44. Conversely, the shoulder pads are loosened by pulling upwardly on a lift tab 58 of the lower buckle 46. This action allows slack to occur within the shoulder pad adjustment strap 44.

The stabilizing strap assembly further includes an upper buckle anchor strap 60 for anchoring the buckle 50 to the top of the backpack by stitching 62. To adjust the angle of the backpack inwardly against the user's back, the free end 64 of the stabilizing strap 48 is pulled. To adjust the backpack outwardly away from a user's back, the lift tab 68 of buckle 60 is pulled upwardly to cause slack to occur within the stabilizing strap 48.

The strap assembly of FIG. 2 differs from the prior art strap assembly of FIG. 1 because the stabilizing strap 48 of FIG. 2 is not directly connected to the shoulder pad 42. Instead, the strap 48 is loosely threaded through cross-straps 66 on the shoulder pads and subsequently threaded through a widened opening within lower buckle 46 and anchored to the bottom of the pack adjacent the anchor point of the shoulder pad adjustment strap 44. The end of a lower portion 70 of the stabilizing strap 48 is stitched directly to the end of strap 44. Upon initial examination, it would appear that this would cause the stabilizing strap to be interconnected with the shoulder pads, but upon further examination it can be seen that the anchoring of the lower portion 70 of strap 48 is merely an anchorage of this strap to the bottom of the backpack, and in no way affects the adjustability of strap 44. It should be appreciated that straps 48 and 44 need not be stitched together at their respective ends and could be, alternatively, stitched separately to the bottom of the pack to achieve the same independent function.

The loosely threaded nature of the stabilizing strap 48 allows the strap to be tightened or loosened without affecting the shoulder pad 42, at all. Conversely, the loosening or tightening of the shoulder pad adjustment strap 44 will not affect the stabilizing strap 48. The independent nature of these two pairs of straps alleviate the need for the tug-of-war adjustment required of the prior art strap assembly of FIG. 1. A single adjustment of the backpack of FIG. 2 only requires a single adjustment of one of the two straps 44 or 48.

FIG. 3 shows an overall perspective view of the strap system 40 of the present invention upon a backpack 80. The backpack shown is an internal frame backpack having a main body 82, a hip belt 84 with belt buckle 86, and a top lid compartment 88 to cover the main enclosure 82. It should be appreciated that the present invention applies equally as well to external frame backpacks. The upper ends 90 of the shoulder pads 42 are anchored to an intermediate point on the backpack by a conventional fastening means such as stitches, rivets, or removable screws. Usually, backpacks also include a chest strap that stretches between the two shoulder pads 42. The chest strap is not shown in FIG. 3 for clarity reasons.

In operation, the backpack is cinched down upon the backpacker's shoulders by pulling on the free ends 56 of both shoulder pad adjustment straps 44. To loosen the backpack upon the shoulders, the lift tabs 58 are pulled upwardly to produce slack within straps 44. To pull the backpack inwardly against a backpacker's back the free ends 64 of both stabilizing straps 48 are pulled downwardly to desired position. To adjust the backpack away from the backpacker's back, the lift tabs 68 of the upper buckles are pulled upwardly to produce slack within the straps 48.

Conventional strap buckles may be used with the strap system of the present invention. However, the strap system operates better with an improved design of the lower buckle 46. FIG. 4 shows details of the lower buckle which includes a cross-piece 92 opposite an angled catch edge 94 to form a slot 96 through which the free end 56 of the strap 44 is threaded (not shown in FIG. 4). The cross-piece and angled edge are conventional within adjustable strap buckles. The angled edge catches and holds the nylon strap until the lift tab 58 is pulled upwardly to release the grip of the edge 94 upon the strap. The major improvement of the lower buckle 46 is the elimination of a second cross-piece usually extending across opening 96. The elimination of the second cross-piece provides for a widened opening that accommodates both the shoulder pad adjustment strap 44 and the lower portion 70 of the stabilizing strap 48. Normally, in conventional strap systems, as shown in FIG. 1, the upper opening within the buckle need not be very large because only the shoulder pad adjustment strap is threaded therethrough. However, in the strap system of the present invention, the widened opening 98 allows the stabilizing strap 48 to slide more easily through the buckle. The free sliding of the strap 48 through lower buckle 46 allows the independent adjustment of straps 44 and 48 to operate more smoothly and effectively with the improved buckle 46.

Although, the improved strap system of the present invention appears simple in design, the independent adjustability of the stabilizing straps and shoulder pads is a significant advance in the prior art of backpacks. The invention alleviates the tug-of-war adjustment required of conventional strap systems. Another significant feature of the present invention is that the basic configuration of the straps upon the backpack remains the same. Specifically, the shoulder pad adjustment straps and the stabilizing straps are positioned at the same general location as the prior art strap system. It is only the operation of the straps that has been changed by the present invention. The improvement of the strap system also does not unduly raise the cost to manufacture the backpack. The design changes that affect the cost of manufacturing the backpack involve lengthening straps 48 and attaching cross-pieces to the shoulder pads. These changes add relatively little to the overall cost of manufacturing the backpack while providing a significant improvement to the operating characteristics of the backpack.

It should be apparent that many modifications could be made to the strap system which would still be encompassed within the spirit of the present invention. It is intended that all such modifications may fall within the scope of the appended claims.

What is claimed is:

1. A backpack in combination with a strap assembly, the strap assembly comprising:

a pair of shoulder pads attached at a first end to said backpack and attached at a second end to a pair of first adjustment buckles, respectively;

a pair of shoulder pad adjustment straps threaded through said first adjustment buckles and anchored at one end, thereof, to said backpack;

a pair of second adjustment buckles attached at one end to said backpack;

a pair of stabilizing straps threaded through said pair of second buckles, respectively, said stabilizing straps anchored at one end, thereof, to said backpack;

means to allow said stabilizing straps to slide freely relative to said shoulder pads;

wherein, said means to allow said stabilizing straps to slide freely provides for independent adjustability of said stabilizing straps and said shoulder pads.

2. A backpack and strap assembly as claimed in claim 1, wherein, each of said pair of stabilizing straps are loosely slidable within a plurality of cross-straps mounted upon each of said pair of shoulder pads.

3. A backpack and strap assembly as claimed in claim 2, wherein, each of said pair of stabilizing straps are loosely slidable within a portion of each of said pair of first adjustment buckles.

4. A backpack and strap assembly as claimed in claim 3, wherein, each of said pair of stabilizing straps are rigidly attached to said backpack adjacent said anchorage of each of said pair of shoulder pad adjustment straps to said backpack.

5. A backpack and strap assembly as claimed in claim 1, wherein, each of said pair of first adjustment buckles comprises a narrow slot formed between an angled catch edge and a cross piece, said slot capable of holding a portion of said shoulder pad adjustment strap;

each of said pair of first adjustment buckles further comprising a single widened opening positioned above said slot, said widened opening capable of holding a portion of said shoulder pad adjustment strap and allowing said stabilizing strap to slide freely therethrough.

6. A backpack and strap assembly as claimed in claim 1, wherein, each of said pair of stabilizing straps comprise a free end extending downwardly from each of said pair of second adjustment buckles, respectively;

wherein, said stabilizing straps are tightened by pulling upon said free ends of said stabilizing straps and said stabilizing straps are loosened by pulling upwardly upon said pair of second adjustment buckles.

7. A backpack and strap assembly as claimed in claim 6, wherein, said free ends of said pair of stabilizing straps and said pair of second adjustment buckles are positioned above said pair of shoulder pads, respectively.

8. A strap assembly for carrying an article upon a person's shoulders comprising:

a pair of shoulder pads attached at a first end to the article and attached at a second end to a pair of first adjustment buckles, respectively;

a pair of shoulder pad adjustment straps threaded through said first adjustment buckles and anchored at one end, thereof, to the article;

a pair of second adjustment buckles attached at one end to the article;

a pair of stabilizing straps threaded through said pair of second buckles, respectively, said stabilizing straps anchored at one end, thereof, to the article;

means to allow said stabilizing straps to slide freely relative to said shoulder pads;

wherein, said means to allow said stabilizing straps to slide freely provides for independent adjustability of said stabilizing straps and said shoulder pads.

* * * * *